US010844448B2

(12) United States Patent
Sundin

(10) Patent No.: US 10,844,448 B2
(45) Date of Patent: Nov. 24, 2020

(54) POWDER METALLURGICALLY MANUFACTURED HIGH SPEED STEEL

(71) Applicant: Erasteel Kloster Aktiebolag, Soderfors (SE)

(72) Inventor: Stefan Sundin, Gavie (SE)

(73) Assignee: ERASTEEL KLOSTER AKTIEBOLAG, Soderfors (SE)

( * ) Notice: Subject to any disclaimer, the term of this patent is extended or adjusted under 35 U.S.C. 154(b) by 346 days.

(21) Appl. No.: 15/824,431

(22) Filed: Nov. 28, 2017

(65) Prior Publication Data

US 2018/0080095 A1 Mar. 22, 2018

Related U.S. Application Data

(60) Division of application No. 14/450,839, filed on Aug. 4, 2014, now abandoned, which is a continuation of application No. 11/989,947, filed as application No. PCT/SE2006/050318 on Sep. 7, 2006, now abandoned.

(30) Foreign Application Priority Data

Sep. 8, 2005 (SE) ..... 0502016
Oct. 27, 2005 (SE) ..... 0502442

(51) Int. Cl.

| | |
|---|---|
| ***C21D 1/18*** | (2006.01) |
| ***C22C 33/02*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/30*** | (2006.01) |
| ***B22F 3/12*** | (2006.01) |
| ***B22F 3/15*** | (2006.01) |
| ***B22F 3/24*** | (2006.01) |
| ***C22C 37/06*** | (2006.01) |
| ***C22C 37/10*** | (2006.01) |
| ***C22C 38/34*** | (2006.01) |
| ***C22C 38/36*** | (2006.01) |
| *B22F 5/00* | (2006.01) |

(52) U.S. Cl.

CPC ..... *C21D 1/18* (2013.01); *B22F 3/1208* (2013.01); *B22F 3/15* (2013.01); *B22F 3/24* (2013.01); *C22C 33/0257* (2013.01); *C22C 33/0285* (2013.01); *C22C 37/06* (2013.01); *C22C 37/10* (2013.01); *C22C 38/02* (2013.01); *C22C 38/04* (2013.01); *C22C 38/22* (2013.01); *C22C 38/24* (2013.01); *C22C 38/30* (2013.01); *C22C 38/34* (2013.01); *C22C 38/36* (2013.01); *B22F 2003/248* (2013.01); *B22F 2005/001* (2013.01); *B22F 2998/00* (2013.01)

(58) Field of Classification Search

CPC ..... C21D 1/18

See application file for complete search history.

(56) References Cited

U.S. PATENT DOCUMENTS

| | | | |
|---|---|---|---|
| 4,145,213 | A | 3/1979 | Oskarsson |
| 4,880,461 | A | 11/1989 | Uchida |
| 5,091,264 | A | 2/1992 | Daxelmueller |
| 5,435,827 | A | 7/1995 | Wisell |
| 5,651,842 | A | 7/1997 | Nakamura |
| 5,754,935 | A | 5/1998 | Yutaka |
| 6,506,270 | B2 | 1/2003 | Takashina |

FOREIGN PATENT DOCUMENTS

| | | |
|---|---|---|
| CN | 1348507 | 5/2002 |
| CN | 1355855 | 6/2002 |
| EP | 0630984 | 12/1994 |
| GB | 2370844 | 7/2002 |
| JP | 9111422 | 4/1997 |
| WO | 93/02819 | 2/1993 |
| WO | 9526421 | 10/1995 |
| WO | 98/40180 | 9/1998 |
| WO | 2007/021243 | 2/2007 |

OTHER PUBLICATIONS

International Search Report issued in PCT/SE2006/05013018, dated Dec. 22, 2006, pp. 1-4.

Shilu Yu, "High speed steel and the forging process for the same," Nation Defense Industry Publisher, pp. 22 and 34, Apr. 30, 1989.

Second Office Action issued in corresponding Chinese Patent Application No. 20131037875X, 7 pages, dated Nov. 17, 2015, and English Translation, 9 pages, Nov. 17, 2015.

Office Action issued in corresponding Chinese Patent Application No. 20131037875X, 8 pages, dated Jan. 28, 2015.

Office Action issued in Chinese Patent Application No. 2006800328363, dated Aug. 21, 2009, 5 pages.

Supplementary European Search Report issued in PCT/SE2006/050318, European Patent Application No. EP 06784231, dated Feb. 2, 2011, 9 pages.

*Primary Examiner* — Christopher S Kessler

(74) *Attorney, Agent, or Firm* — Jeffrey S. Melcher; Melcher Patent Law PLLC

(57) ABSTRACT

The present invention relates to a high speed steel with a chemical composition that comprises, in % by weight: 0.6-2.1 C 3-5 Cr 4-14 Mo max 5 W max 15 Co 0.5-4 V, balance Fe and impurities from the manufacturing of the material, which steel is powder metallurgically manufactured and has a content of Si in the range of $0.7<Si\leq 2$.

16 Claims, 3 Drawing Sheets

POWDER METALLURGICALLY MANUFACTURED HIGH SPEED STEEL

TECHNICAL FIELD

The invention relates to a high speed steel with a chemical composition that comprises, in % by weight, 0.6-2.1 C, 3-5 Cr, 4-14 Mo, max 5 W, max 15 Co and 0.5-4 V, balance Fe and impurities from the manufacturing of the steel. The steel is intended to be used in cutting applications such as for drills, milling cutters and bandsaws.

BACKGROUND

Steel intended for cutting applications such as for drills, milling cutters and bandsaws, should preferably be characterised by good grindability and high edge strength. An example of a material with these properties is the conventionally manufactured high speed steel denoted HS2-9-1-8, the chemical composition of which is 1.0-1.15 C, 7.50-9.0 Co, 3.50-4.50 Cr, 9.00-10.00 Mo, 0.90-1.5 V, 1.20-1.90 W and max 0.70 Si.

High contents of Si in conventionally manufactured high speed steels will often result in large carbides, which large carbides will negatively affect grindability and edge strength, e.g. A good edge strength will contribute to a long life, an even life, and will enable high speed feeding, i.e. a high load on the edge. A good grindability is important primarily in the manufacturing of a tool from the steel, since the grinding of cutting edges etc. is a time consuming operation.

BRIEF ACCOUNT OF THE INVENTION

It is an object of the present invention to provide a material to be used in cutting applications and having improved properties in respect of hardness and edge strength. This is achieved, somewhat surprisingly, by a high speed steel that is characterised by being powder metallurgically manufactured and by having a content of Si in the range of $0.7<Si\leq 2\%$ by weight. Besides this, the material should also fulfil some of the following criteria; it should have an improved toughness/strength, life and grindability, at the same time as the material should be as easy to mild machine (e.g. mill with a cutter, turn and drill) as materials known today for such applications.

According to further aspects of the invention, the steel:

- comprises 1.5 Si at the most, even more preferred 1.1 Si at the most.
- comprises 0.7-0.9 Si, preferably 0.75-0.85 Si, most preferred 0.78-0.82 Si.
- comprises max 1.5 C, preferably 1.0-1.15 C.
- comprises max 3.5-4.5 Cr, preferably 3.7-4.0 Cr.
- comprises 6-12 Mo, preferably 9-10 Mo, most preferred 9.2-9.7 Mo.
- comprises 1-3 W, preferably 1.2-1.9, most preferred 1.3-1.7 W.
- comprises max 12 Co, preferably 7.5-9.0 Co, most preferred 7.7-8.2 Co.
- comprises 0.9-2.5 V, preferably max 1.5 V, most preferred 1.1-1.2 V.
- is hardened at a temperature of 1100-1200° C.
- is intended for bimetallic saw blades, preferably using a tempering temperature of 600-650° C. and a tempering time in the range of 0.5-10 min.
- is intended to be used in other types of cutting operations, preferably using a tempering temperature of 500-600° C. and a tempering time in the range of 0.5-4 h.

DETAILED DESCRIPTION OF THE INVENTION

Figure 1:
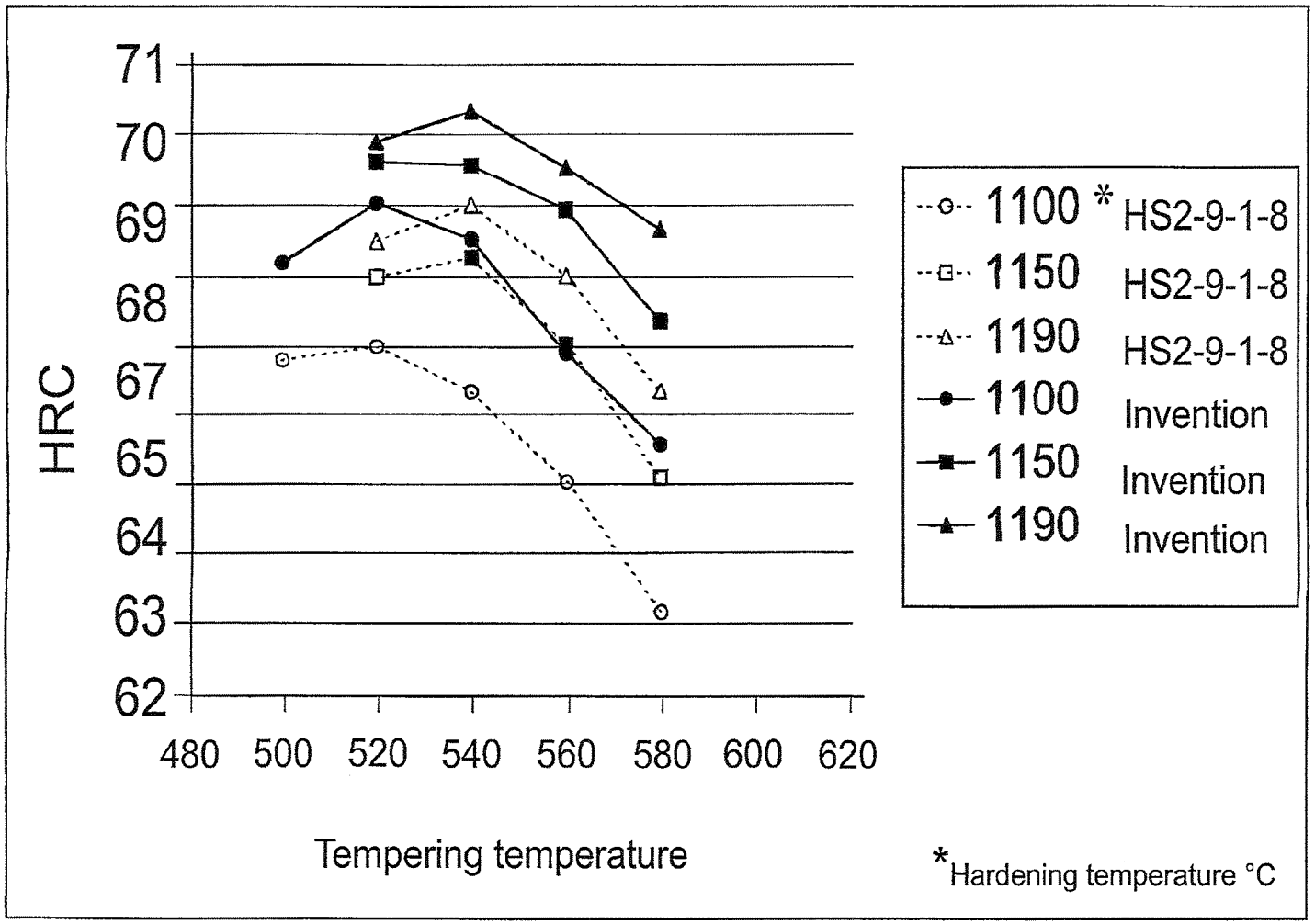
FIG. 1 is a diagram showing hardness as a function of tempering temperature.

Without restricting the invention to any particular theory, the importance of the various alloying elements and of the various structural elements in achieving the desired property profile, will be explained in further detail. Percentages are always given in % by weight for alloying elements and in % by volume for structural elements, unless otherwise stated.

Carbon should exist at a content of 0.6 to 2.1%, more preferably 0.6 to 1.5%, and most preferred 1.0 to 1.15%, in order, when dissolved in the martensite, to result in a hardness in the hardened and tempered condition which is suitable for the application. Carbon should furthermore, in combination with vanadium, contribute to an adequate amount of primary precipitated MC-carbides, and, in combination with tungsten, molybdenum and chromium to contribute to the achievement of an adequate amount of primary precipitated $M_6C$-carbides in the matrix. The purpose of such carbides is to give the material its desirable resistance to wear. Furthermore, they contribute in giving the steel a fine-grained structure as the carbides may function to limit the grain growth. In a preferred embodiment of the invention, the carbon content is in the range of 1.06 to 1.10%.

To some extent, carbon can be replaced by nitrogen that for example can be added to the material in connection with the manufacturing process, e.g. in the atomization, if nitrogen gas is used as a medium for atomization and protection. Accordingly, nitrogen contents of up to about 0.3% can be achieved in the steel by a powder metallurgical manufacturing process. It is thereby understood that the carbides formed in the steel also may contain a certain amount of nitrogen, which means that the denotation "carbides" also should comprise carbonitrides and/or nitrides.

Silicon should be present at a content of at least 0.7% with the purpose of giving the steel a desired combination of hardness, toughness and abrasive durability. An increased content of silicon may however lead to an increased amount of primary precipitated $M_6C$-carbides at the expense of secondary precipitated carbides such as MC- and $M_2C$-carbides. Hardness after tempering can also be negatively affected by high amounts of silicon, which means that the steel preferably should contain not more than 2%, more preferred not more than 1.5% and most preferred not more than 1.0% Si.

In a preferred embodiment of the invention, the content of silicon is in the range of 0.7 to 0.9%, more preferred 0.75 to 0.85%, and most preferred in the range of 0.78 to 0.82%.

Manganese can also be present primarily as a residual product from the metallurgical melt process in which manganese has the known effect of putting sulphuric impurities out of action by the formation of manganese sulphides. The maximum content of manganese in the steel is 3.0%, preferably not more than 0.5% and nominally about 0.4% manganese.

Sulphur may be present in the steel as a residual product from the manufacturing of the steel, at contents of up to 800 ppm, without affecting the mechanical properties of the steel. Sulphur can be deliberately added as an alloying element, up to 1% at the most, thus contributing to improved machineability.

Also phosphorus may be present in the steel as a residual product from the manufacturing of the steel, at contents of up to 800 ppm, without affecting the mechanical properties of the steel.

Chromium should exist in the steel at a content of at least 3%, preferably at least 3.5%, in order to, when dissolved in the matrix of the steel, contribute to the steel achieving adequate hardness and toughness after hardening and tempering. Chromium can also contribute to the resistance to wear of the steel by being included in primarily precipitated hard phase particles, mainly $M_6C$-carbides. Also other primarily precipitated carbides contain chromium, however not to the same extent. Too much chromium will however result in a risk of residual austenite that can be hard to convert, in particular in combination with high amounts of silicon. For this reason, the steel should not contain more than 5% at the most, preferably not more than 4.5%, of chromium. In a preferred embodiment, the steel contains 3.7 to 4.0% chromium.

Molybdenum and tungsten will, just like chromium contribute to the matrix of the steel getting adequate hardness and toughness after hardening and tempering. Molybdenum and tungsten can also be included in primarily precipitated carbides of the $M_6C$-type of carbides and as such it will contribute to the resistance to wear of the steel. Also other primarily precipitated carbides contain molybdenum and tungsten, however not to the same extent. The limits are chosen in order to, by adaptation to other alloying elements, result in suitable properties. In principle, molybdenum and tungsten can partially or completely replace each other, which means that tungsten can be replaced by half the amount of molybdenum, or molybdenum can be replaced by double the amount of tungsten. High contents of silicon may lead to a depletion of molybdenum in the martensite, and also to a depletion of tungsten after hardening, to a certain extent, which will lead to impaired hardness in the hardened and tempered condition. It has however been shown for the steel according to the invention that it is beneficial to let the content of molybdenum be considerably larger than the content of tungsten, above all in consideration of the content of silicon in the steel, whereby the steel can be given a desired amount of secondary precipitated carbides. Hence, the content of molybdenum in the steel should be in the range of 4 to 14%, more preferred 6 to 12%, and suitably 9 to 10%. The content of tungsten in the steel should be max 5%, more preferred 1 to 3%, and suitably 1.2 to 1.9%. In a preferred embodiment, the steel contains 9.2 to 9.7% molybdenum and 1.3 to 1.7% tungsten.

The optional presence of cobalt in the steel depends on the intended use of the steel. For applications in which the steel is normally used at room temperature or is normally not heated to particularly high temperatures in use, the steel should not contain deliberately added cobalt, since cobalt reduces the toughness of the steel. If the steel is to be used in chip cutting tools, for which hot hardness is of prominence, it is however suitable for it to contain considerable amounts of cobalt, which in that case can be allowed at contents of up to 15%, more preferred not more than 12%. In order to achieve the desired hot hardness, a suitable content of cobalt lies in the range of 7.5 to 9%. In a preferred embodiment, the steel contains 7.7 to 8.2% cobalt.

Vanadium should exist in the steel at a content of at least 0.5 and 4% at the most, in order to form very hard vanadium carbides together with carbon, i.e. hard materials of the MC-type. To avoid larger MC-carbides, having a negative influence on the grindability of the steel, the steel should preferably not contain more than 2.5%, and even more preferred not more than 1.5% vanadium. In order to achieve a desired secondary hardening, the steel should contain at least 0.9% vanadium. In a preferred embodiment, the steel contains 1.1 to 1.2% vanadium.

Optionally, vanadium can be completely or partly replaced by niobium, but suitably the steel does not contain any deliberately added niobium since it may complicate scrap handling in a steel works.

Besides that, the steel according to the invention should not contain any deliberately added additional alloying elements. Copper, nickel, tin and lead and carbide-formers such as titanium, zirconium and aluminium may be allowed at a total content of not more than 1%. Besides these and the above mentioned elements, the steel contains no other elements than unavoidable impurities and other residual products from the metallurgical melt treatment of the steel.

The steel of the invention is preferably manufactured by using hot isostic pressing; Capsules are filled with metal powder. The metal powder is preferably pre-alloyed but it is also possible to use a mix of different powders in order for the final steel to contain the appropriate amounts of alloying elements. After filling, the capsules are sealed. The capsules are thereafter pressed in a cold isostatic press, e.g. Asea QI 100, at a pressure of at least 1000 bar, preferably around 4000 bar. The capsules are thereafter placed in a pre-heating furnace, where the temperature is stepwise risen to a temperature of 900-1250° C., e.g. 1130° C., without being subjected to any externally applied pressure. After preheating, the capsules are transferred to a hot isostatic press, e.g. HIPen Asea QI 80, where a pressure at least above 500 bar, e.g. 1000 bar, is applied at a temperature of 900-1250° C., e.g. 1150° C. The temperature is controlled so that the material is consolidated without presence of liquid phase. The consolidation of the material without presence of liquid phase limits the growth of carbides thereby enhancing grindability and edge strength. (It may e.g. also be possible to achieve a consolidation of the material without presence of liquid phase through the use of extrusion.) The steel material is now finished for further treatments such as forging, rolling, tempering etc. typically used in steel manufacturing industry. As a skilled person realises the cold isostatic press step as well as the following preheating step are used mainly for process economic reasons and it would very well be possible to transfer the sealed capsules directly to a hot isostatic press without prior cold pressing or preheating.

Microstructure

The steel according to the invention should have a content of MC-carbides of not more than 8% by volume, preferably not more than 5% by volume, and even more preferred not more than 3% by volume, where at least 80%, preferably at least 90%, and even more preferred at least 95% of the MC-carbides have a carbide size in the longest extension of the carbide of not more than 4 μm, preferably not more than 3.5 μm, and even more preferred not more than 3 μm. The composition of the steel should also be balanced in respect of the $M_6C$-carbide-forming elements chromium, molybdenum and tungsten, such that the content in the steel of $M_6C$-carbides will be not more than 25% by volume, preferably not more than 20% by volume and even more preferred not more than 17% by volume, where at least 80%, preferably 90%, and even more preferred at least 95% of the $M_6C$-carbides have a carbide size in the longest extension of the carbide of not more than 9 μm, preferably not more than 7 μm, and even more preferred not more than 5 μm.

In a preferred embodiment of the invention, the high speed steel is characterised by having a content of MC-carbides of not more than 3% by volume, where at least 99% of the MC-carbides have a carbide size in the longest extension of the carbide of not more than 3.5 μm, and having a content of $M_6C$-carbides of not more than 17% by volume, where at least 99% of the $M_6C$-carbides have a carbide size in the longest extension of the carbide of not more than 7 μm, preferably not more than 5 μm.

The high speed steel according to the invention has a Brinell hardness in its soft-annealed condition of about 250-270 HB, which is comparable with a conventionally manufactured high speed steel of the type HS2-9-1-8, and which is important since it proves that the material should be as easy to mild machine (e.g. to mill with a cutter, turn and drill) as is a conventionally manufactured material of the type HS2-9-1-8.

The steel according to the invention has a microstructure that in the hardened and tempered condition consists of a structure of tempered martensite containing MC-carbides and $M_6C$-carbides that are evenly distributed in the martensite, obtainable by hardening of the product from an austenitizing temperature of between 1100 and 1200° C., cooling to room temperature and tempering at 500-650° C. Depending on the field of application, the tempering operation is adapted to obtain a desired combination of properties for the purpose. If the steel is intended for bimetallic saw blades, a tempering temperature of 600-650° C. and a tempering time in the range of 0.5-10 min are suitably employed. If the steel is intended for other types of cutting operations, such as for the manufacturing of drills, milling cutters, saws or other solid tools, a tempering temperature of 500-600° C. and a tempering time of 0.5-4 h are suitably used. By "solid tools" are understood tools manufactured of a single material but which may have a surface coated with some other material, such as titanium nitride, titanium aluminium nitride, as a comparatively thin surface layer. By such a heat treatment, a steel can be obtained with a microstructure that gives the steel a good strength in combination with a good hardness, improved toughness, life and grindability. A hardness in the range of 65-71 HRC can be achieved in the hardened and tempered condition, which is in the magnitude of 1-2 HRC units more than high speed steels known today for cutting applications.

DESCRIPTION OF THE EXPERIMENTS 10 tons of the high speed steel (steel A) were manufactured in a full scale test, from which steel a steel powder was manufactured by nitrogen gas atomization. Capsules were manufactured from the powder, which capsules were compacted by HIP:ing. The steel was compared with a reference material (steel B), which was a conventionally manufactured material of the type HS2-9-1-8. The chemical composition for the tested materials is shown in Table 1 below.

TABLE 1

| Steel | C | Si | Mn | Cr | Mo | W | Co | V |
|---|---|---|---|---|---|---|---|---|
| A | 1.09 | 0.78 | 0.24 | 3.77 | 9.35 | 1.58 | 7.82 | 1.20 |
| B | 1.08 | 0.32 | 0.26 | 3.86 | 9.36 | 1.46 | 7.86 | 1.14 |

The diagram in FIG. 1 shows hardness as a function of tempering temperature for the steel according to the invention compared with the reference material HS2-9-1-8. It is clear from the figure that the material according to the invention, when hardened at 1100-1200° C. and tempered in the range of 500-580° C., 3×1 h, reaches a hardness in the range of 65-71 HRC. All steels according to the invention have a hardness that is in the magnitude of 1-2 HRC units higher than the reference material. A hardness in the range of 65-71 HRC can be obtained also at a tempering temperature of 650° C., but then with a considerably shorter tempering time.

Figure 2:
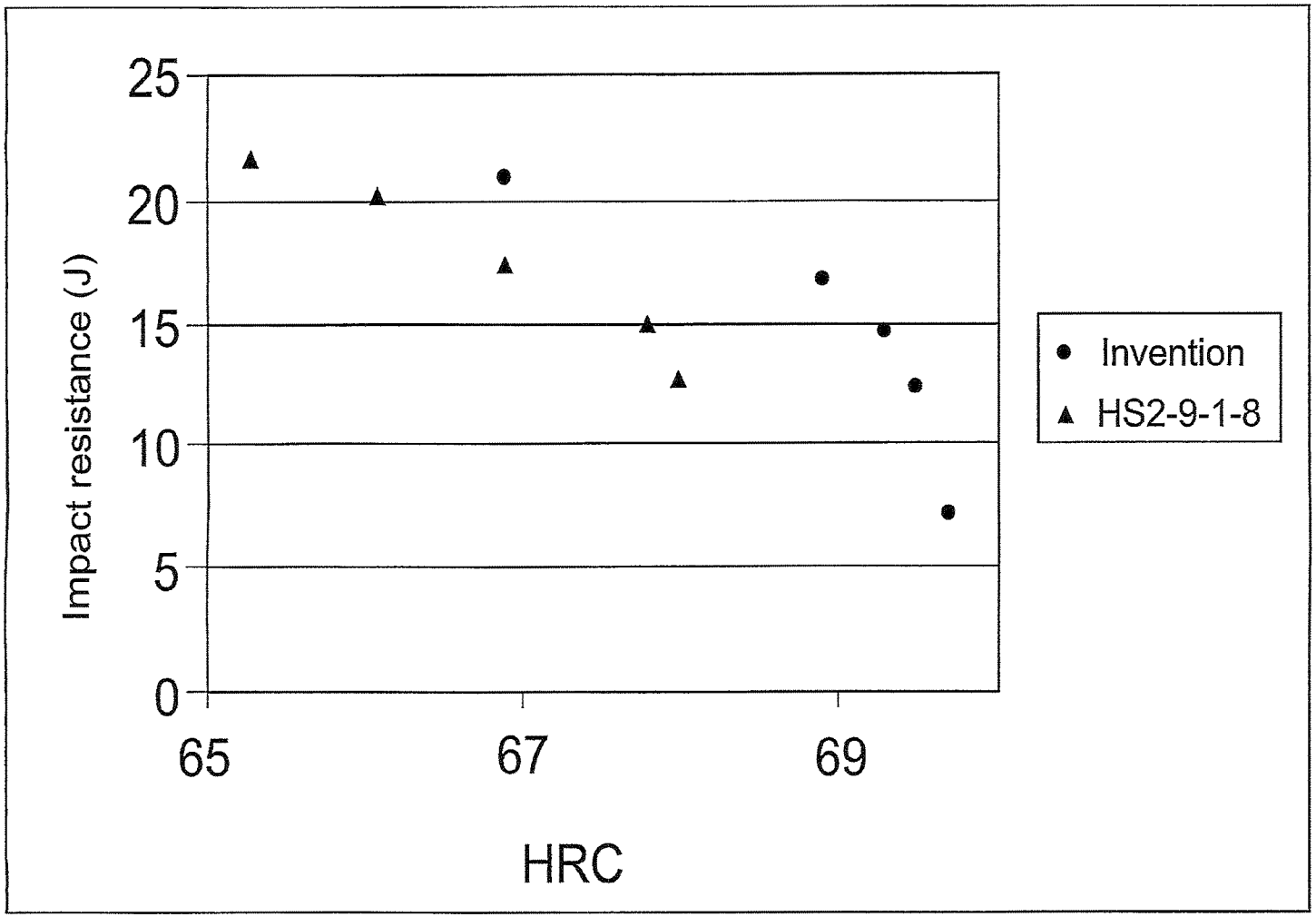
FIG. 2 is a diagram showing toughness as a function of hardness.

The diagram in FIG. 2 shows toughness as a function of hardness, and it is clear that also in this respect the high speed steel according to the invention has a better hardness than the reference material at a comparable impact resistance, or a better impact resistance at a comparable strength.

Figure 3:
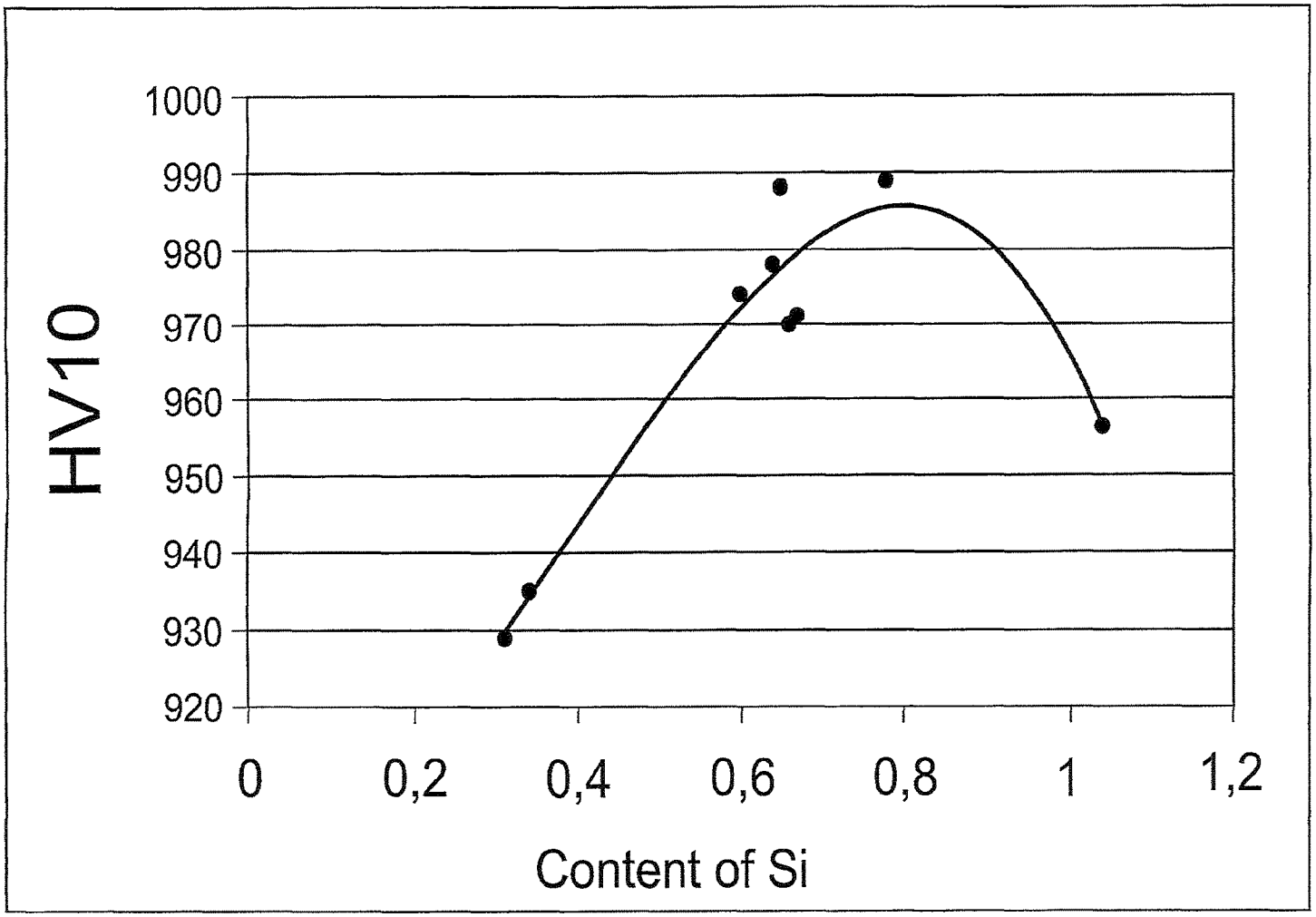
FIG. 3 is a diagram showing hardness in the hardened condition as a function of Si content.

The diagram in FIG. 3 shows hardness after hardening at 1180° C. and tempering at 560° C., 3×1 h, as a function of the content of Si for the high speed steel according to the invention, and it is clear that an optimum is found for contents of Si in the range of 0.7-0.9% by weight.

In comparative saw tests between the high speed steel according to the invention and the reference material, it has also been shown that saw blades for band saws made from the high speed steel according to the invention have about 30% longer life in tests with sawing in a low-alloy high speed steel called E MAT II (applicant's denotation), and up to about 20% longer life in tests with sawing in a stainless steel, which must be considered to be surprisingly good results. Accordingly, a steel according to the invention provides for a high speed steel with a considerably improved property profile, which above all makes the steel suitable for use in cutting applications.

The invention claimed is:

1. A process for producing a powder metallurgical manufactured high speed steel for cutting applications having a chemical composition that comprises, in % by weight:

0.6-2.1 C+N,
max 0.3 N,
3-5 Cr,
4-14 Mo,
max 3 W,
max 15 Co,
0.5-4 Nb+V,
0.7-2 Si,
max 3 Mn,
max 1 S,
max 800 ppm P,
max 1 Cu+Ni+Sn+Pb+Ti+Zr+Al,
balance Fe and inevitable impurities said process comprises the steps:

a) filling a capsule with metal powder comprising iron and the alloying elements accordingly with the chemical composition of the steel,
b) sealing the capsule,
c) hot isostatically pressing the capsule in a hot isostatic press, at a pressure of at least above 500 bar and a HIP temperature of 900-1250° C., consolidating the steel material without presence of liquid phase, d) hardening at 1100-1200° C., and e) tempering in the range of 500-600° C. within a tempering time range of 0.5-4 h, to thereby obtain a highspeed steel having a hardness of 65-71 HRC, and a content of MC-carbides of not more than 8% by volume, where at least 80% of the MC-carbides have a carbide size in the longest extension of the carbide of not more than 4 μm, and a content of $M_6C$-carbides of not more than 25% by volume, where at least 80% of the $M_6C$-carbides have a carbide size in the longest extension of the carbide of not more than 9 μm, to manufacture drills, milling cutters, saws or other solid tools.

2. The process according to claim 1, wherein between step b) and step c) the capsule is cold isostatically pressed in a cold isostatic press.

3. The process according to claim 1, wherein prior to step c) the capsule is preheated in a preheating furnace, gradually increasing the furnace temperature to a temperature close to the HIP temperature used in step c).

4. A cutting tool manufactured according to claim 1.

5. A cutting tool according to claim 4, having a content of MC-carbides of not more than 5% by volume, where at least 90% of the MC-carbides have a carbide size in the longest extension of the carbide of not more than 3.5 μm, and that it has a content of $M_6C$-carbides of not more than 20% by volume by volume, where at least 90% of the $M_6C$-carbides have a carbide size in the longest extension of the carbide of not more than 7 μm.

6. A cutting tool according to claim 4, having a content of MC-carbides of not more than 3% by volume, where at least 95% of the MC-carbides have a carbide size in the longest extension of the carbide of not more than 3 μm, and that it has a content of $M_6C$-carbides of not more than 17% by volume, where at least 95% of the $M_6C$-carbides have a carbide size in the longest extension of the carbide of not more than 5 μm.

7. A cutting tool according to claim 4, having a content of MC-carbides of not more than 3% by volume, where at least 99% of the MC-carbides have a carbide size in the longest extension of the carbide of not more than 3.5 μm, and that it has a content of $M_6C$-carbides of not more than 17% by volume, where at least 99% of the $M_6C$-carbides have a carbide size in the longest extension of the carbide of not more than 7 μm.

8. A cutting tool according to claim 4, having a content of MC-carbides of not more than 3% by volume, where at least 99% of the MC-carbides have a carbide size in the longest extension of the carbide of not more than 3.5 μm, and that it has a content of $M_6C$-carbides of not more than 17% by volume, where at least 99% of the $M_6C$-carbides have a carbide size in the longest extension of the carbide of not more than 5 μm.

9. A process for producing a powder metallurgical manufactured high speed steel for cutting applications having a chemical composition that comprises, in % by weight:

0.6-2.1 C+N,
max 0.3 N,
3-5 Cr,
4-14 Mo,
max 3 W,
max 15 Co,
0.5-4 Nb+V,
0.7-2 Si,
max 3 Mn,
max 1 S,
max 800 ppm P,
max 1 Cu+Ni+Sn+Pb+Ti+Zr+Al,
balance Fe and inevitable impurities said process comprises the steps:

a) filling a capsule with metal powder comprising iron and the alloying elements accordingly with the chemical composition of the steel, b) sealing the capsule, c) hot isostatically pressing the capsule in a hot isostatic press, at a pressure of at least above 500 bar and a HIP temperature of 900-1250° C., consolidating the steel material without presence of liquid phase, d) hardening at 1100-1200° C., and e) tempering at 600-650° C. at 0.5-10 min, to thereby obtain a highspeed steel having a hardness of 65-71 HRC, and a content of MC-carbides of not more than 8% by volume, where at least 80% of the MC-carbides have a carbide size in the longest extension of the carbide of not more than 4 μm, and a content of $M_6C$-carbides of not more than 25% by volume, where at least 80% of the $M_6C$-carbides have a carbide size in the longest extension of the carbide of not more than 9 μm, to manufacture bimetallic sawblades.

10. The process according to claim 9, wherein between step b) and step c) the capsule is cold isostatically pressed in a cold isostatic press.

11. The process according to claim 9, wherein prior to step c) the capsule is preheated in a preheating furnace, gradually increasing the furnace temperature to a temperature close to the HIP temperature used in step c).

12. A cutting tool manufactured according to claim 9.

13. A cutting tool according to claim 12, having a content of MC-carbides of not more than 5% by volume, where at least 90% of the MC-carbides have a carbide size in the longest extension of the carbide of not more than 3.5 μm, and that it has a content of $M_6C$-carbides of not more than 20% by volume by volume, where at least 90% of the $M_6C$-carbides have a carbide size in the longest extension of the carbide of not more than 7 μm.

14. A cutting tool according to claim 12, having a content of MC-carbides of not more than 3% by volume, where at least 95% of the MC-carbides have a carbide size in the longest extension of the carbide of not more than 3 μm, and that it has a content of $M_6C$-carbides of not more than 17% by volume, where at least 95% of the $M_6C$-carbides have a carbide size in the longest extension of the carbide of not more than 5 μm.

15. A cutting tool according to claim 12, having a content of MC-carbides of not more than 3% by volume, where at least 99% of the MC-carbides have a carbide size in the longest extension of the carbide of not more than 3.5 μm, and that it has a content of $M_6C$-carbides of not more than 17% by volume, where at least 99% of the $M_6C$-carbides have a carbide size in the longest extension of the carbide of not more than 7 μm.

16. A cutting tool according to claim 12, having a content of MC-carbides of not more than 3% by volume, where at least 99% of the MC-carbides have a carbide size in the longest extension of the carbide of not more than 3.5 μm, and that it has a content of $M_6C$-carbides of not more than 17% by volume, where at least 99% of the $M_6C$-carbides have a carbide size in the longest extension of the carbide of not more than 5 μm.

* * * * *